US005694480A

United States Patent [19]

Itakura

[11] Patent Number: 5,694,480

[45] Date of Patent: Dec. 2, 1997

[54] MOLTEN SLAG FLOW RATE MEASURING DEVICE AND FURNACE FACILITIES USING THE SAME

[75] Inventor: Masaharu Itakura, Tokyo, Japan

[73] Assignee: Tsukishima Kikai Co., Ltd., Tokyo, Japan

[21] Appl. No.: 521,438

[22] Filed: Aug. 30, 1995

[51] Int. Cl.[6] ..... G06K 9/00; C21C 1/04; C21B 7/24; H04N 7/18

[52] U.S. Cl. ..... 382/141; 348/83; 75/387; 266/100

[58] Field of Search ..... 382/141; 348/83; 266/100, 92, 227, 230, 264; 222/594, 590; 75/387

[56] References Cited

U.S. PATENT DOCUMENTS

| | | | |
|---|---|---|---|
| 4,315,771 | 2/1982 | Bobillon | 348/83 |
| 5,139,412 | 8/1992 | Kychakoff et al. | 348/83 |
| 5,162,906 | 11/1992 | Yorita et al. | 348/83 |
| 5,505,435 | 4/1996 | Laszlo | 266/230 |

FOREIGN PATENT DOCUMENTS

| | | | |
|---|---|---|---|
| 59-50058 | 3/1984 | Japan . | |
| 3-17208 | 1/1991 | Japan . | |
| 3-282109 | 12/1991 | Japan . | |
| 5-311213 | 11/1993 | Japan . | |
| WO 81/02466 | 9/1981 | WIPO . | |
| 89/07156 | 8/1989 | WIPO | 266/100 |

OTHER PUBLICATIONS

"Development of Blast Furnace Slag Flow Rate Meter and its Application to Granulated Slag Sand Making Process", K. Sano et al., pp. 2581–2586, IFAC Control Science and Technology, Kyoto, Japan, 1981.

Abstract of Japanese Patent Publ. No. 58–172514, dated Oct. 11, 1983.

*Primary Examiner*—Leo Boudreau
*Assistant Examiner*—Bhavesh Mehta
*Attorney, Agent, or Firm*—Nikaido, Marmelstein, Murray & Oram LLP

[57] ABSTRACT

Vortex melting furnace facilities picks up an image of molten slag flow in a direction traverse to the molten slag flow discharged from the furnace, calculates a molten slag flow rate by brilliance discrimination of the image pick-up signal and controls a water feed rate of a molten slag wet granulation and granulated slag dewatering apparatus and a flow rate of the molten slag in the vortex melting furnace. A video camera is arranged such that a direction of image pick-up traverses to a direction of the molten slag flow and the resulting image is brilliance discriminated by a high brilliance area for the molten slag and a low brilliance area for a molten slag conduit, and the high brilliance area is converted to the fusion flow rate from a liquid level of the molten slag in the fusion conduit. In the molten slag wet granulation and granulated slag dewatering apparatus, when the molten slag flow rate exceeds a predetermined level as detected from the measurement of the flow rate, the normal water flow rate is increased to a predetermined level. In the vortex melting furnace, the flow rate of the molten slag at an exit of the melting furnace is fed back to the pitcher to control the flow rate of the molten slag.

5 Claims, 5 Drawing Sheets

MOLTEN SLAG FLOW RATE MEASURING DEVICE AND FURNACE FACILITIES USING THE SAME

BACKGROUND OF THE INVENTION

The present invention relates to a molten slag flow rate measuring device for measuring a flow rate of molten slag discharged from molten slag generating furnace facilities, and relates to the molten slag wet granulation and granulated slag dewatering apparatus using said device which measures an amount of molten slag discharged from blast furnace and in turn controls the corresponding water supply rate as well as to the sludge vortex melting furnace facility using said device which measures an amount of molten slag discharged from the furnace and in turn controls the corresponding powdered cake feed rate into the furnace.

In prior art measurement of a flow rate of fusion, a dam system (together with a supersonic level meter) has been used. A demerit of this system is that the fusion is solidified to a fusion surface or a dam area so that a precise interface of the fusion cannot be determined and an exact flow rate control is not attained. A place at which such an apparatus is installed is in a bad installation environment such as high temperature or dusty and the reliability and durability of the apparatus are poor and not practical. By those reasons, it is an actual state that the apparatus was installed but the furnace is operated without actual measurement.

In a prior art molten slag wet granulation apparatus, a flow rate of fusion flown into the molten slag wet granulation apparatus is controlled based on a process rate of a dehydrator, as disclosed in JP-A-59-50058. In this system, however, since the wet granulation process is conducted by a feedback control by using, as a parameter, the process rate of the dehydrator disposed in a succeeding stage to a blow box in which the wet granulation is actually conducted, the system includes a time lag, and when the flow rate of fusion flowing into the processing unit abruptly increases, a flow rate of water to be jetted is short so that a quality of the wet granulated slag is lowered and in an extreme case, there is a risk of water vapor explosion.

In another prior art as disclosed in JP-A-5-311213, it is proposed to switch more water to a higher temperature portion based on a temperature distribution along a width of the flow-in fusion. However, in order to manufacture high quality wet granulated slag, it is necessary to assure a water pressure which is high enough to apply certain level of impact to the fusion and a jet water flow rate corresponding to the fusion flow rate, and the above method is not always effective to manufacture the high quality wet granulated slag.

In JP-A-3-282109 which discloses prior art vortex melting furnace facilities, because of lack of effective means for measuring a flow rate of molten slag flowing out of a melting furnace, an injection flow rate of powdered cake into the melting furnace is controlled by supplying it by a constant rate feed device, but it is difficult to control the molten slag discharge rate at a predetermined level because properties of the powdered cake such as apparent specific gravity vary.

SUMMARY OF THE INVENTION

Problems which the present invention intends to solve are that the method of directly measuring the molten slag flow rate discharged from the furnace facilities is poor in the reliability and the durability and involves the time lag, and in the molten slag wet granulation apparatus for manufacturing the wet granulated slag from such molten slag, it is not possible to assure proper water jet rate necessary to the molten slag wet granulation process. Further, in the vortex melting furnace, it is difficult to control the discharge flow rate of molten slag.

The present invention is characterized by picking up an image of the fusion flow in a direction transverse to the fusion flow discharged from the furnace facilities and calculating a fusion flow rate based on brilliance discriminating the picked-up image signal. A water flow rate of the molten slag wet granulation and granulated slag dewatering apparatus is controlled and a discharge rate of the molten slag in the vortex melting furnace is controlled based on the calculated molten slag flow rate.

DESCRIPTION OF THE PREFERRED EMBODIMENTS

Figure 1:
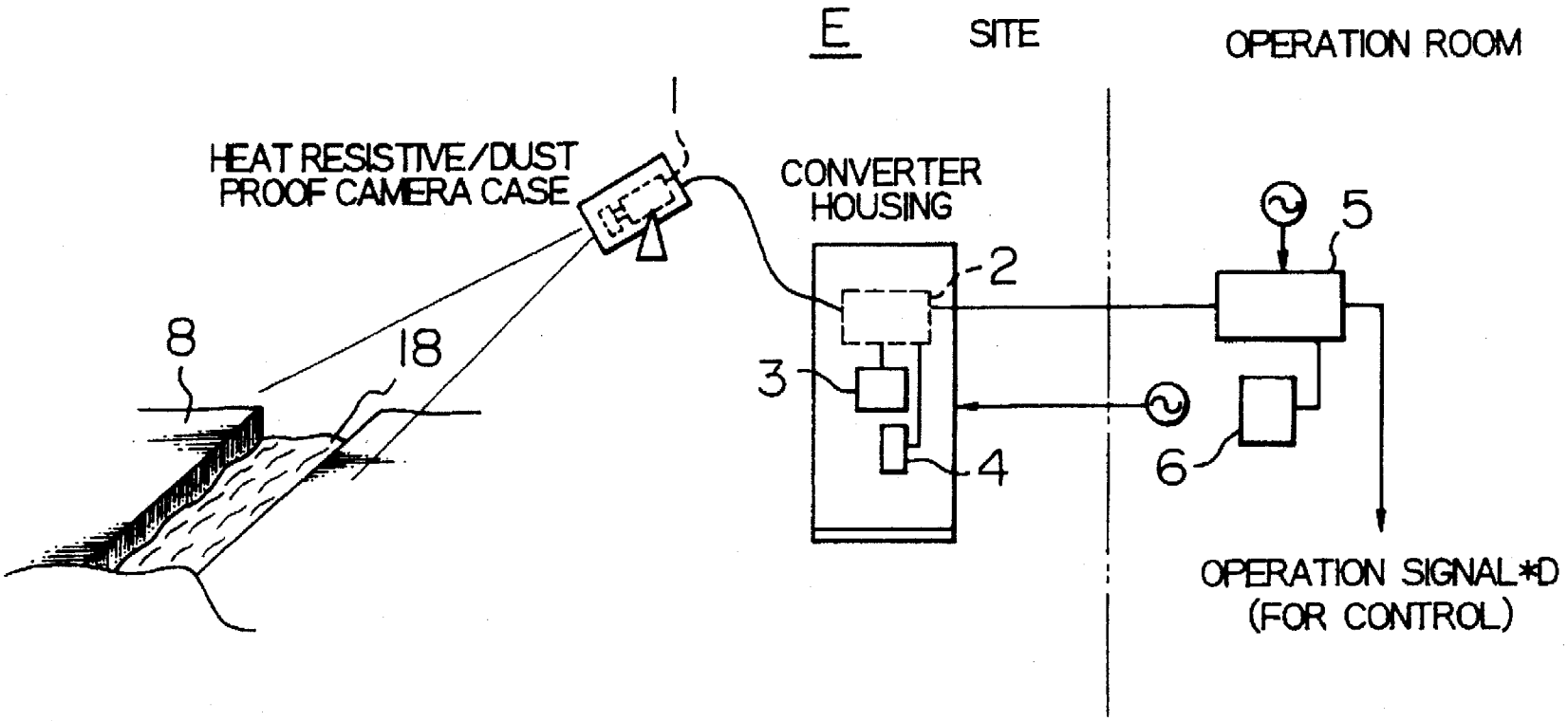
FIG. 1 shows a configuration of a molten slag flow rate measuring device of the present invention.

An embodiment of the present invention is now explained with reference to the accompanying drawings. FIG. 1 shows an overall view of a configuration of a fusion flow rate measuring device E. In the present embodiment, the fusion flow rate measuring device E is applied to a high temperature furnace. A video camera 1 housed in a heat resistive/dust proof camera case is arrange obliquely above a fusion conduit 8 through which fusion 18 of the high temperature furnace flows out. The video camera 1 is oriented such that a direction of image pick-up traverses to a direction of flow of the fusion 18 in the fusion conduit 8. A video signal of the fusion 18 picked up by the video camera 1 is sent to a converter housing.

The converter housing houses an image processing unit 2 for image processing an input video signal, a display 3 for displaying an input raw video signal or a processed video signal to be described later and an input selector 4 for selecting the processing by the image processing unit 2 or the display by the display 3. The video camera 1 and the converter housing are arranged in a site of the high temperature facilities, for example.

Arranged in a on operation room remote from the site are sequencer 5 for receiving the output signal from the image processing unit 2 and generating an operation sequence and an operation output for transferring the processed signal to other apparatus or facilities or further processing the signal, and a program loader 6 for operation programming of the sequencer 5. The converter housing and the sequencer 5 are powered by an appropriate power source.

Figure 2A:
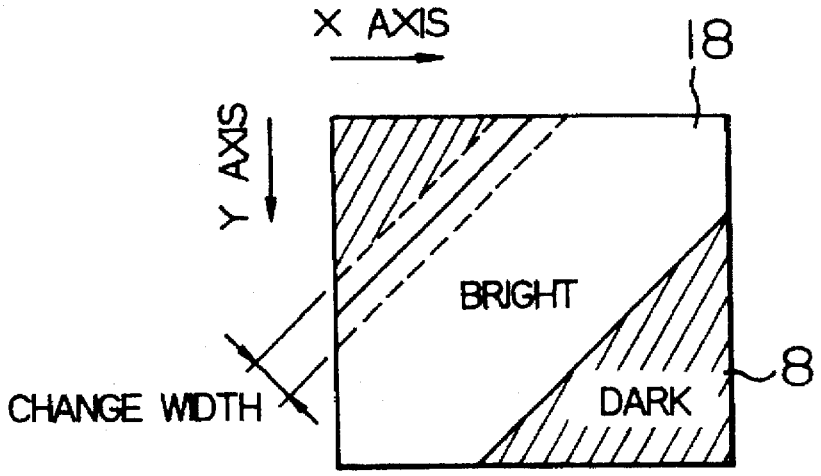
FIG. 2A shows an example of picked-up image by an image pick-up device of the molten slag flow rate measuring device.
Figure 2B:
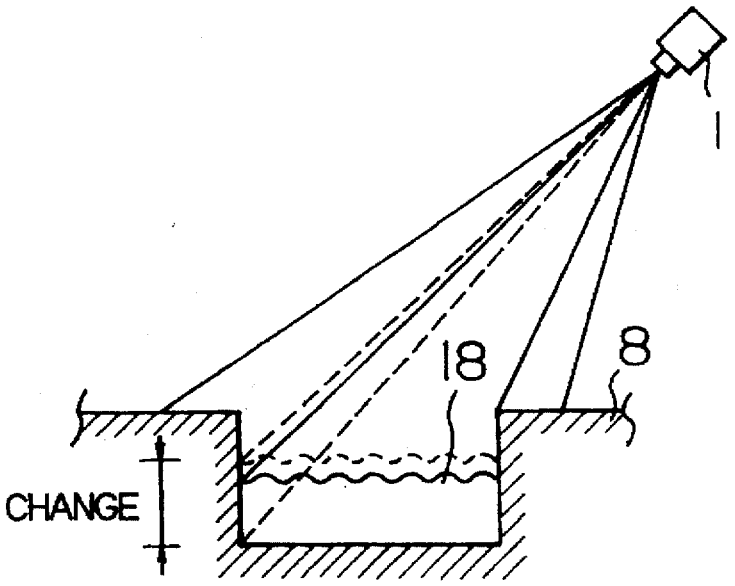
FIG. 2B shows a positional relation between the image pick-up device and a fusion conduit.

Referring to FIGS. 2A and 2B, a principle of processing of the video signal of the fusion 18 picked up by the video camera 1 is explained. FIG. 2A shows an image of the fusion 18 and the conduit 8 picked up by the video camera 1 and FIG. 2B shows a positional relation of the fusion conduit 8 and the video camera 1. As seen from FIG. 2B, in the present embodiment, the video camera 1 is arranged at such a position obliquely above the fusion conduit 8 through which the fusion flows out that the entire width of the fusion 18 and at least a portion of the fusion conduit 8 fall within an image pick-up range.

Of the image signal picked up by the video camera 1, the area of the fusion 18 which is at a high temperature and a high brilliance appears bright and the area of the fusion conduit 8 which is at a relatively low temperature and low brilliance appears dark. When the flow rate of the fusion 18 flowing into the fusion conduit 8 changes, the liquid level of the fusion 18 in the fusion conduit 8 changes and the area of side walls of the fusion conduit 8 which are covered by the fusion 18 also changes. The change in the side wall area appears as a relative change of bright/dark areas of different brilliance in the video signal as shown in FIGS. 2A and 2B.

By setting an experimentarily determined brilliance discrimination value of the fusion 18 and the fusion conduit 8 in the image processing unit 2 and conducting the image processing based on the set value, the change in the flow rate of the fusion 18 flowing through the fusion conduit 8 appears as a change in the high brilliance area. Accordingly, by setting an actually measured sectional area of the fusion conduit 8 and the experimentarily determined area change parameter of the high brilliance area to the change in the flow rate of the fusion 18 into the image processing unit 2, the flow rate of fusion 18 can be calculated by the brilliance processing of the video signal picked up by the video camera 1.

Accordingly, a program which calculates a setting from a steady state flow rate (a high brilliance area) and outputs a signal when the high brilliance area (flow rate of the fusion 18) exceeds the predetermined rate may be set in the image processing unit 2. The signal indicating the flow rate of the fusion 18 or the signal indicating that the flow rate of the fusion 18 has exceeded the predetermined level, generated by the image processing unit 2 is sent to the sequencer 5 which converts it to the operation output for other apparatus or facilities.

In using the fusion flow rate measuring device, the video camera 1 is mounted obliquely above the fusion conduit 8 in the site and the position and the zooming of the video camera are adjusted while monitoring the image on the display 3 such that the video signal of the fusion conduit 8 and the fusion 8 appears as shown in FIG. 2A, and the discrimination brilliance is set by the input selector 4 and the flow rate calculation formula by the bright/dark area ratio and the parameters are set in the image processing unit 2. Further, the control output based on the output of the image processing unit 2 or the format of the operation signal is set in the sequencer 5 by using the program loader. Such initialization process may be appropriately conducted in accordance with the object to be measure and the target to be controlled as will be described later.

Figure 3:
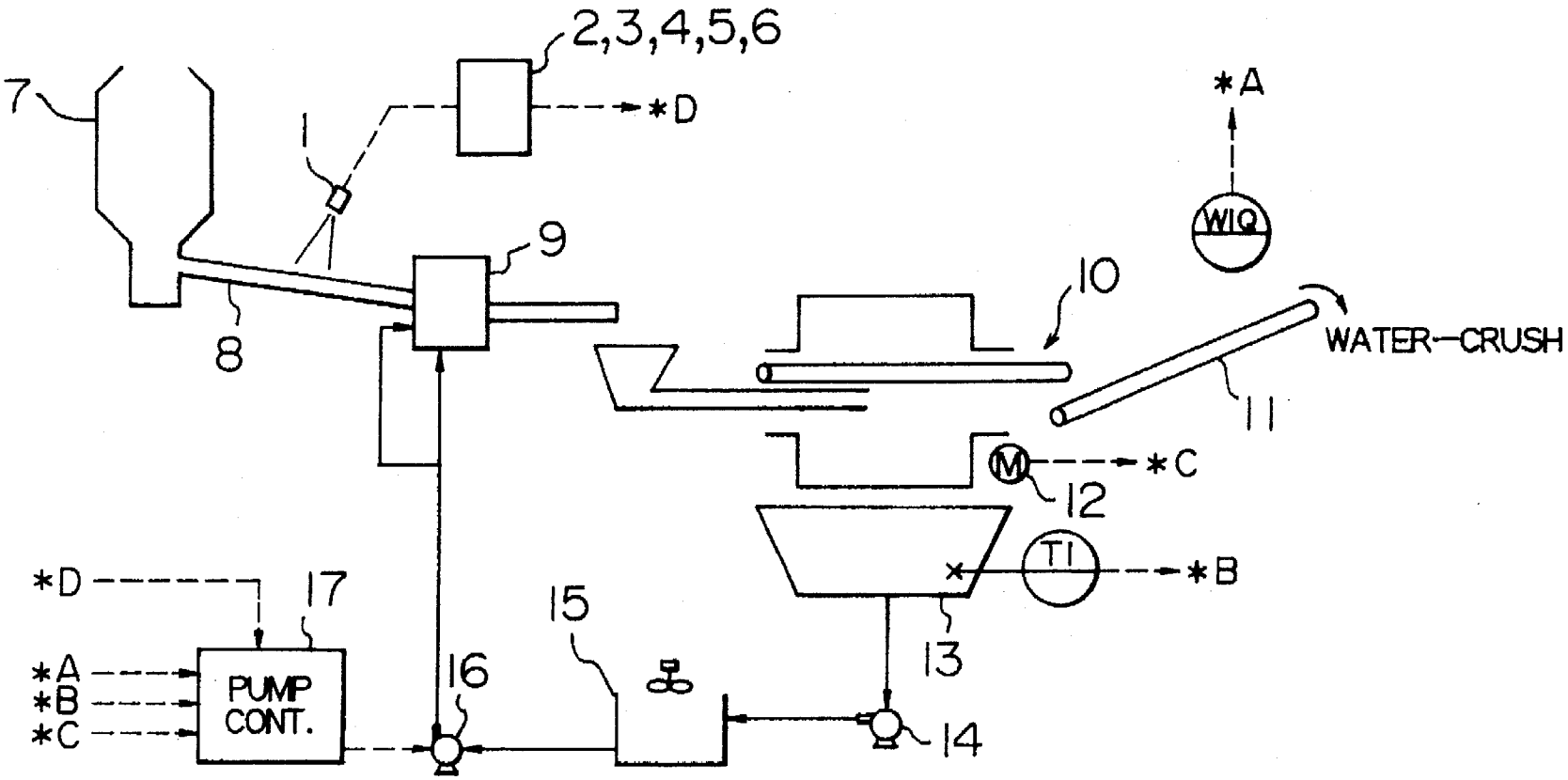
FIG. 3 shows a configuration of a molten slag wet and granulated slag dewartering apparatus which employs the molten slag flow rate measuring device.

An embodiment in which the fusion flow rate measuring device is applied to a molten slag wet granulation and granulated slag dewatering apparatus shown in FIG. 3 is now explained.

In FIG. 3, the fusion 18 flowing out of a high temperature furnace 7 is transported to a blow box 9 through the fusion conduit 8, and jet water of a constant pressure is applied in the blow box 9 and then it is dehydrated by a dehydrator 10 and discharged by an ejection conveyer 11 as wet granular slag. The water separated by the dehydrator 10 is collected in a dehydrated water bath 13, pressurized by a circulation pump 14, cooled by a cooling tower 15 and fed out by a water feed pump controlled by a pump controller 17 for reuse by the blow box 9 as jet water. In the present molten slag wet granulation and granulated slag dewatering apparatus, the fusion flow rate measuring device is set such that when the flow rate of the fusion 18 abruptly increases above a predetermined level, a signal *D indicating that the wet granulated slag flow rate has been exceeded is outputted.

The fusion flow rate measuring device shown in FIGS. 1, 2A and 2B is arranged in the fusion conduit 8 of the water-crush slag processing apparatus. In the present arrangement, a normal operation is conducted by using the existing molten slag granulation and granulated dewatering apparatus. Namely, the number of water feed pumps operated is controlled in accordance with wet granulated slag generation amount (WIQ) signal *A indicating changes in dehydration amount, water temperature and load as the flow-in fusion increases, a dehydrated liquid bath temperature (TI) signal *B and a power load *C of the wet granulated slag dehydrator to optimally control the granulation flow rate.

When the flow rate of the fusion 18 from the high temperature furnace 7 abruptly increases, the fusion flow rate measuring device is operated and the signal *D indicating that the setting of the fusion 8 has been exceeded interrupts the granulation water flow rate control signal inputted to the pump controller 17. When the pump controller 17 receives the signal *D, it cause the stand-by pump to start the operation to increase the granulation water flow rate to the predetermined level. In this manner, a feedforward control is applied so that safe and economic control is attained without time lag. When the signal *D is not inputted for a predetermine time, that is, when the fusion flow rate returns to the steady state, the conventional water feed pump operation is recovered.

Figure 4:
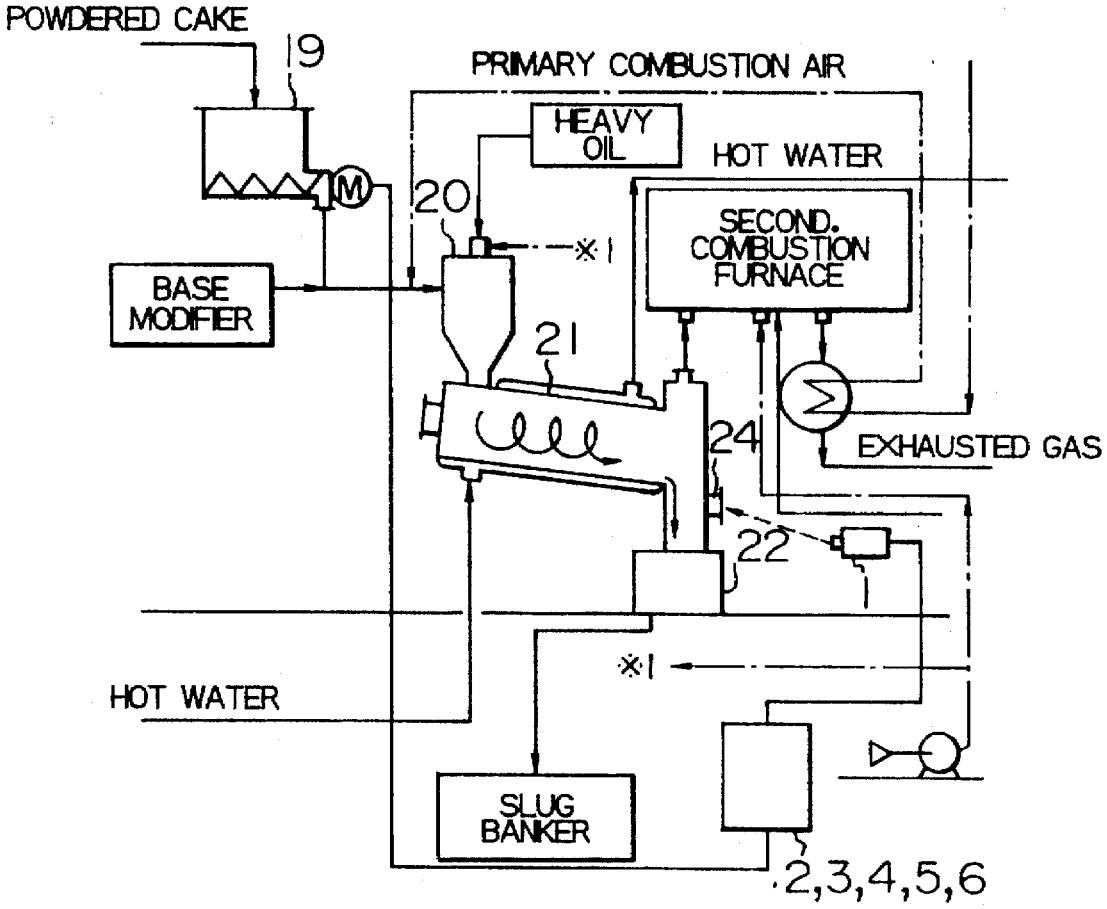
FIG. 4 shows a configuration of a vortex melting furnace which employs the molten slag flow rate measuring device.
Figure 5:
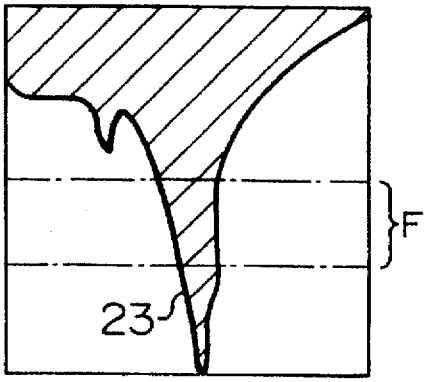
FIG. 5 shows an example of image processing screen in the vortex melting furnace.

Referring to FIGS. 4 and 5, an embodiment in which the molten slag flow rate measuring device E of the present invention is applied to a vortex melting furnace is explained. The melting furnace facilities comprise a pitcher 19, a burner 20, a melting furnace 21 and a cooler 22. A monitor window 24 is formed at a position to allow the observation of lower portion of liquid at an exit of the molten slag of the melting furnace 21 and the video camera 1 of the molten slag flow rate measuring device E is positioned at the image pickup position. In the picked-up image of the video camera 1, the flow-down molten slag 23 as viewed from the exit of the melting furnace 21 appears as a high brilliance area and the background appears as a low brilliance area as shown in FIG. 5. The image processing unit 2 measures a brilliance area of a bar-like discrimination zone F shown in FIG. 5 which is preset by the input selector 2 to calculate the flow rate of the molten slag 23. The resulting flow rate of the molten slag 23 is fed back to the pitcher 26 to control the material input rate so that the flow-out rate of the molten slag is properly controlled. The discrimination zone F is set into the image processing unit 2 by the input selector 4 while watching the display 3 when the fusion flow rate measuring device E is installed.

Figure 6:
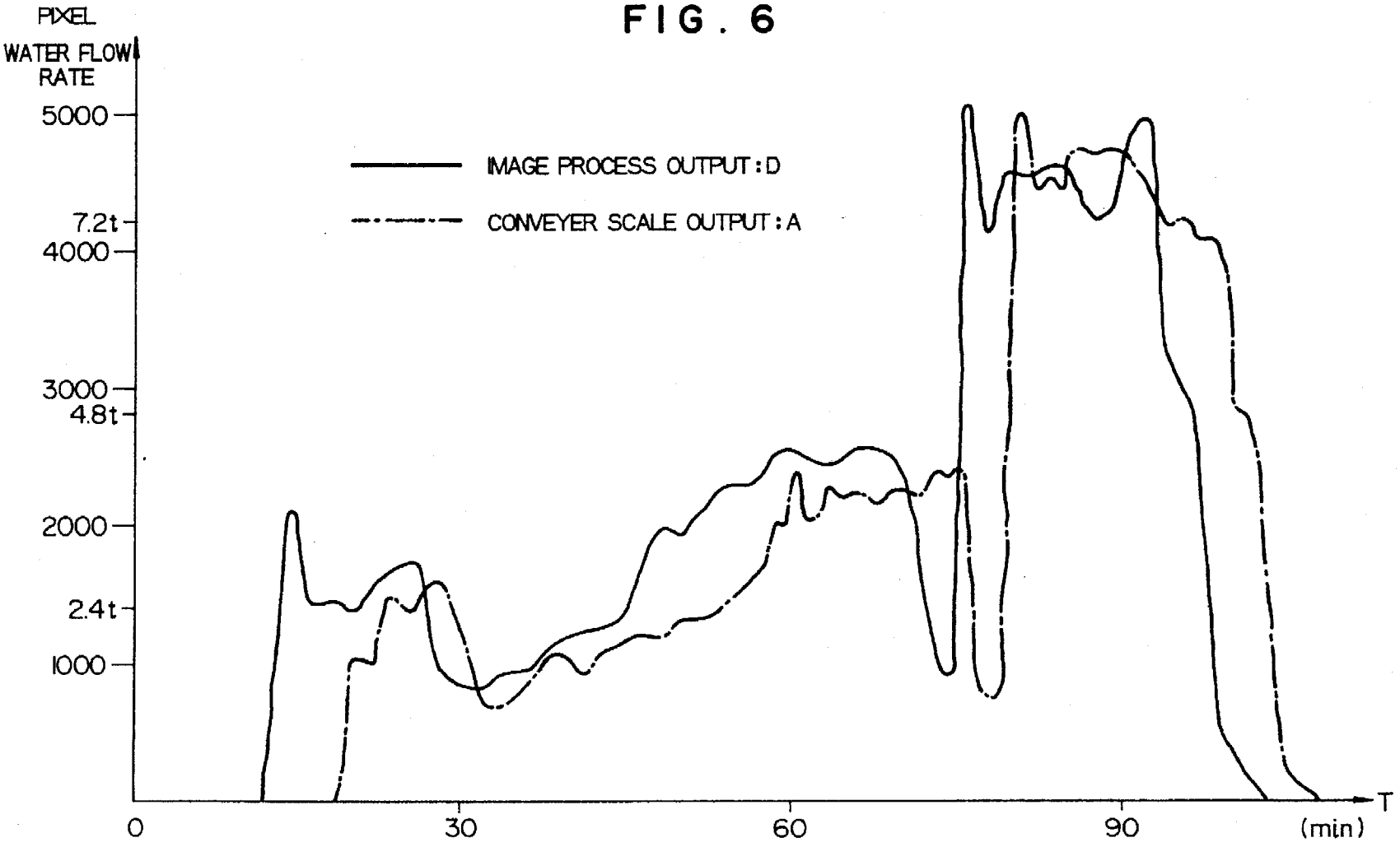
FIG. 6 shows measurements of an image process output D and a conveyer scale output A.

FIG. 6 shows measurements of an image process output D (shown by a solid line) in the furnace facilities having the fusion flow rate measuring device installed therein in the embodiment of the present invention and a conveyer scale output A (shown by a chain line). It is seen from the measurements that the calculated data and the measurement data substantially coincide, with the time lag corresponding to the line delay time for the fusion to reach the downstream ejection conveyer, for the image output D, and fusion flow rate can be grasped by the image processing for the fusion conduit 8 prior to the measurement at the conveyer scale and the exact water flow rate control is attained on real time.

In the fusion flow rate measuring device of the embodiment described above, since the image of the fusion flow is picked up in the direction transverse to the direction of the fusion flow and the fusion flow rate is calculated by the brilliance discrimination of the image signal, the highly reliable and durable fusion flow rate measuring device is attained. In the molten slag granulation and granulated slag dewatering apparatus which uses the present fusion flow rate measuring device, the water flow rate is controlled based on the flow-in rate of the fusion so that the time lag is not involved and the control process rapidly responds to the abrupt change in the fusion flow rate and the quality of product is maintained. Further, in the control of the flow rate of the molten slag in the vortex melting furnace, exact control of the flow rate is attained.

What is claimed is:

1. A molten slag rate measuring device comprising:

an image pick-up device positioned obliquely above molten slag, such that a direction of image pick-up transverses to a flow direction of molten slag discharged from furnace facilities for outputting an image pick-up signal of the molten slag as a bright area in an image pick-up range; and an image processing unit for receiving the image pick-up signal from said image pick-up device and calculating and outputting a molten slag rate by brilliance discrimination of the image pick-up signal by discriminating a width of the bright area transverse to the flow direction of molten slag in the image Dick-up range.

2. A molten Slag rate measuring device according to claim 1, wherein said furnace facilities comprises a high temperature furnace and said image pick-up device is arranged in a direction to obliquely traverse a fusion conduit of said high temperature furnace from the top of the fusion conduit.

3. A molten slag rate measuring device according to claim 1 wherein said furnace facilities comprise a vortex melting furnace and said image pick-up device is arranged in a direction to traverse molten slug flow of said vortex melting furnace.

4. A molten slag granulation and granulated slag dewatering apparatus for generating granulated slag by jetting pressured water to fusion discharged from a high temperature furnace, comprising:

an image pick-up device positioned obliquely above molten slag, such that a direction of image pick-up traverses to a flow direction of molten slag discharged from said high temperature furnace for outputting an image pick-up signal of the molten slag as a bright area in a image Pick-up range;

an image processing unit for receiving the image pick-up signal from said image pick-up device and calculating and outputting a molten slag rate by brilliance discrimination of the image pick-up signal by discriminating a width of the bright area transverse to the direction of molten slag in the image Pick-up range; and control means for increasing a granulation water flow rate to a predetermined level when the molten slag rate calculated by said image processing unit exceeds a predetermined level.

5. Vortex melting furnace facilities having a pre-burning furnace and a main burning furnace, comprising:

an image pick-up device positioned obliquely above molten slag such that a direction of image pick-up traverses to a direction of molten slag discharged from said main burning furnace for outputting an image pick-up signal of the molten slag as a bright area in an image Pick-up range;

an image processing unit for receiving the image pick-up signal from said image pick-up device and calculating and outputting a molten slag flow rate by brilliance discrimination of the image pick-up signal; and control means for controlling a material feed rate to said pre-burning furnace such that the molten slag flow rate calculated by said image processing unit reaches a predetermined level.

* * * * *